United States Patent [19]

Howell

[11] Patent Number: 4,512,439

[45] Date of Patent: Apr. 23, 1985

[54] CONTROL MECHANISM FOR AERIAL LADDERS

[75] Inventor: Donald J. Howell, Franklin County, Kans.

[73] Assignee: Sponco Mfg., Inc., Ottawa, Kans.

[21] Appl. No.: 529,215

[22] Filed: Sep. 6, 1983

[51] Int. Cl.[3] ..... E06C 5/04

[52] U.S. Cl. ..... 182/66; 182/208

[58] Field of Search ..... 182/66–68, 182/208, 207, 2

[56] References Cited

U.S. PATENT DOCUMENTS

| | | | |
|---|---|---|---|
| 3,196,979 | 7/1965 | Garnett . | |
| 3,360,076 | 12/1967 | Stilwell . | |
| 3,396,814 | 8/1968 | Garnett | 182/2 |
| 3,489,243 | 1/1970 | Prescott et al. . | |
| 4,089,388 | 5/1978 | Johnson | 182/2 |

*Primary Examiner*—Reinaldo P. Machado
*Assistant Examiner*—Alvin Chin-Shue
*Attorney, Agent, or Firm*—Kokjer, Kircher, Bradley, Wharton, Bowman & Johnson

[57] ABSTRACT

In a multiple extending section aerial ladder, a control linkage which allows the elevation, rotation and extension of the ladder to be controlled both from its base and from a working station on its top end. Two sets of rotatable tubes on the middle section of the ladder receive rotatable rods mounted on the upper and lower sections. The sets of rods and tubes rotate together, and each rod can extend out of and retract into its tube to accommodate extension and retraction of the ladder. The tubes in the two sets are connected in pairs by crank arms which cause the tubes in each pair to rotate together but in opposite directions. Hydraulic valves which control the ladder functions can be operated directly from the base of the ladder by hand levers on the lower set of rods. The valves can also be operated through the control linkage by handles on the upper set of rods.

11 Claims, 7 Drawing Figures

CONTROL MECHANISM FOR AERIAL LADDERS

BACKGROUND AND SUMMARY OF THE INVENTION

This invention relates generally to aerial ladders and more particularly to a mechanical linkage which allows a multiple section aerial ladder to be controlled from both its base end and its top or working end.

Truck mounted aerial ladders are useful in a variety of applications such as performing work on billboards and other outdoor signs and other elevated devices. The aerial ladder is typically mounted in the bed of a truck on a turret which permits the ladder to be varied in its rotational position. The ladder can also be pivoted up and down to control the elevation of its top or working end. The type of aerial ladder to which the present invention pertains includes multiple sections which can be extended and retracted relative to one another to vary the overall length of the ladder. Hydraulic motors and cylinders are provided to rotate, elevate and extend the aerial ladder under the control of hydraulic valves that are actuated by hand levers.

It is desirable to provide the ladder with one set of controls at its base end and with another set of controls at its top end. This permits the ladder to be controlled from the ground and also by a worker stationed on the top end of the ladder. Often, the working end of the ladder is equipped with a bucket or basket which carries a worker, and work can be carried out safely and expeditiously if the worker is able to start and stop and control the ladder from his station in the basket.

U.S. Pat. No. 3,360,076 to Stilwell; U.S. Pat. No. 3,489,243 to Prescott et al and U.S. Pat. No. 3,196,979 to Garnett disclose the telescoping aerial booms which have controls located on the top of the boom where they can be manipulated by a worker carried in the basket. In the case of a telescoping boom, the control rods can easily extend within the hollow boom and there are no severe space limitations. However, in the case of an aerial ladder, it is necessary to avoid obstructing the working area of the ladder with control linkages and the like, and it is much more difficult to provide a control linkage which extends the entire length of the ladder without hindering extension and retraction of the ladder sections. To my knowledge, there have been no successful insulated mechanical control systems developed for aerial ladders which permit all functions of the ladder to be controlled from both the top and base ends of the ladder.

It is the primary object of the present invention to provide, in a multiple extending section aerial ladder, an insulated mechanical control linkage which permits all functions of the ladder to be controlled from both the base end and from the elevted working end of the ladder.

Another object of the invention is to provide a control linkage of the character described which is installed at an unobtrusive location on the ladder. The components of the linkage system are mounted between the sides of the three ladder sections where they can properly interact with one another without obstructing the working area of the ladder.

Yet another object of the invention is to provide control linkage of the character described in which each ladder function has one control lever at the base end of the ladder and another control lever on the working end of the ladder. It is a significant feature of the invention that the control levers in each pair are moved in the same direction (up or down) in order to effect the same direction of ladder movement. The linkage between each pair of levers includes a reversal mechanism which compensates for the differences between the direct acting upper levers and the beam type lower levers.

A further object of the invention is to provide a linkage of the character described which presents only nonconducting materials in the vicinity of the ladder tip. Electrically conducting materials are insulated at the ladder tip so that work near power lines and other electrical devices can be carried out safely.

An additional object of the invention is to provide a linkage of the character described which is simple and economical to construct and install and which functions in a safe and reliable manner.

Other and further objects of the invention, together with the features of novelty appurtenant thereto, will appear in the course of the following description.

DETAILED DESCRIPTION OF THE INVENTION

In the accompanying drawings which form a part of the specification are to be read in conjunction therewith and in which like reference numerals are used to indicate like parts in the various views.

Figures 1, 2, 7:
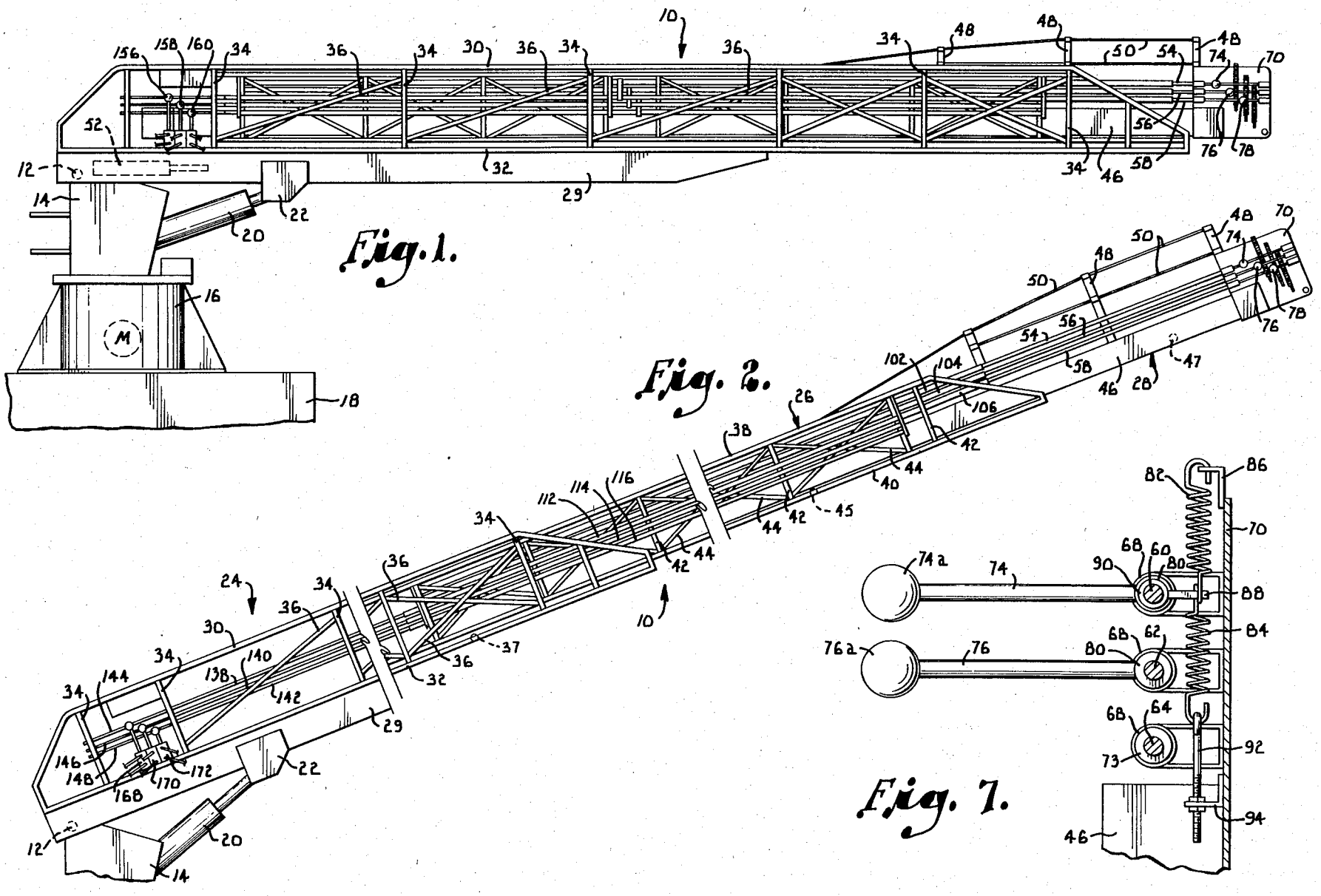
FIG. 1 is a side elevational view of a truck mounted aerial ladder equipped with a control system constucted according to a preferred embodiment of the present invention, with the ladder fully retracted and lowered to the storage position.
FIG. 2 is a side elevational view similar to that of FIG. 1, but with the ladder extended and raised to a working position, the break lines indicating continuous length.
FIG. 7 is a fragmentary sectional view on an enlarged scale taken generally along line 7—7 of FIG. 4 in the direction of the arrows.

Referring now to the drawings in more detail and initially to FIGS. 1 and 2, numeral 10 generally designates a three section aerial ladder. The base end of the ladder 10 is pivotally mounted by a hinge 12 to a turret 14 which is in turn mounted for rotation on a pedestal 16 secured to a truck bed 18. The hinge 12 provides a horizontal axis about which the ladder can be raised and lowered in order to vary the elevation of its top or working end. The elevation of the ladder is controlled by a hydraulic cylinder 20 having its base end pivoted to the turret 14 and its rod end pivoted to a beam (not shown) extending between a pair of brackets 22 secured to the ladder. Extension and retraction of the cylinder 20 in the elevation mode pivots the ladder 10 up and down about the horizontal hinge 12.

A hydraulic motor M and a cooperating drive system of conventional construction rotate the turret 14 about a vertical rotational axis in order to vary the rotational position of the ladder with respect to the stationary pedestal 16. The rotation drive system can be of any suitable type and serves to rotate the turret 14 through a full 360° circle in the rotation mode of operation.

As best shown in FIG. 2, the aerial ladder 10 is formed by a lower bed section 24, a middle or intermediate section 26, and an upper fly section 28. The lower section 24 has its base end pivoted to the turret 14 and includes reinforcing structural supports 29 to which the brackets 22 are secured. The lower section includes parallel opposite sides formed by top and bottom rails 30 and 32 between which vertical bars 34 extend at spaced intervals. Inclined bars 36 extend between each pair of vertical bars 34. Horizontal bars extending between the opposite bottom rails 32 form the usual ladder rungs, one of which is indicated at 37 in FIG. 2.

The middle section 26 is similar to the lower section 24 but is not as wide. Opposite sides of the middle section include upper and lower rails 38 and 40, vertical bars 42 extending between the upper and lower rails, and inclined bars 44 extending between the vertical bars 42. Ladder rungs such as the rung 45 (FIG. 2) extend between the opposite bottom rails 40.

The middle section 26 is supported to extend and retract relative to the lower section 24. The sides of the main section are located inwardly of the sides of the lower section, and the bottom rails 40 and rungs of the middle section are located slightly above the bottom rails 32 and rungs of the lower section. The middle section 26 nests within the lower section 24 when the ladder is fully retracted, as shown in FIG. 1. When the ladder is extended, the middle section extends out of the lower section and forms a continuation thereof, as shown in FIG. 2.

The upper section 28 has parallel fiberglass rectangular sections 46 on it opposite sides between which rungs extend, as indicated by the rung 47 shown in FIG. 2 Extending upwardly from the beams 46 are vertical posts 48. Rods 50 are supported by the posts 48 to form hand rails for workers on the upper ladder section and also act as truss rods. The hand rails 50 are located on the portion of the upper ladder section which extends out of the middle ladder section when the ladder is fully extended as shown in FIG. 2.

The upper ladder section 28 is somewhat smaller than the middle section 26 and extends out of and retracts into the middle section when the ladder is extended and retracted. The side beams 46 are closer together than the sides of the middle ladder section 26, and the rungs of the upper ladder section are slightly above the rungs of the middle ladder section. When the ladder is in the fully retracted condition shown in FIG. 1, the upper ladder section 28 nests within the middle ladder section 26.

Extension and retraction of the ladder is effected by a hydraulic cylinder 52 (see FIG. 1) which is combined with a conventional cable and pulley system (not shown) in order to cause the ladder sections to extend relative to one another when the rod of cylinder 52 is extended and to retract into one another in nesting relation when the cylinder is retracted.

The control linkage of the present invention includes three elongate rods 54, 56 and 58 which are mounted for rotation on the upper ladder section 28 outwardly of one of its sides. The rods 54, 56 and 58 are square in cross section and are preferably constructed of fiberglass. Rigidly connected with the upper end of rod 54 and forming a continuation thereof is a cylindrical rod 60. The top ends of rods 56 and 58 are similarly connected with cylindrical rods 62 and 64. Each of the cylindrical rods 60, 62 and 64 is supported for rotation by an upper sleeve 66 and a lower sleeve 68. The sleeves 66 and 68 are secured to a mounting plate 70 which is in turn secured to one of the side beams 46 of the upper ladder section 28. Each rod 60, 62 and 64 is provided with a pair of collars 72 and 73 which are located adjacent to the sleeves 66 and 68 and which prevent the rods from sliding axially with respect to the sleeves. In this manner, each rod 54, 56 and 58 is mounted on the upper ladder section 28 for rotation and is held against axial movement relative to the upper ladder section.

The cylindrical rods 60, 62 and 64 are provided with respective hand levers or handles 74, 76 and 78 which are used to rotate the rods. Each control handle is rigidly connected with the corresponding rod such that movement of the handle up and down rotates the rod in opposite directions. Each handle is secured to a collar 80 which is in turn secured to the corresponding rod by a set screw or similar fastener. Round knobs 74*a*, 76*a* and 78*a* are mounted on the outer ends of the respective control handles 74, 76 and 78.

A pair of tension springs 82 and 84 act on each rod 60, 62 and 64 to continuously urge the rod and the associated control handle toward a neutral position. The handles 74, 76 and 78 extend horizontally at predetermined angles to plate 70 when centered in their neutral position. With particular reference to FIG. 7, each spring 82 is hooked at its top end to a bracket 86 secured to plate 70. The bottom end of each spring 82 is hooked to a lug 88 which extends from a collar 90 secured to the corresponding rod 60, 62 or 64. The other spring 84 is hooked at its top end to lug 88 and at its bottom end to an eye bolt 92 mounted on a bracket 94 secured to plate 70. Each eye bolt 92 can be adjusted to adjust the tension of spring 84.

When one of the control handles is displaced from the neutral position, one of the springs 82 or 84 is stretched, depending upon whether the control handle is displaced upwardly or downwardly. When the handle is released, the spring which is in a stretched condition returns it to the neutral position. The control handles 74, 76 and 78 are staggered and are conveniently accessible to a worker stationed on the upper ladder section 28 or in a basket (not shown) carried on the upper ladder section. Torsion springs (not shown) can be used instead of tension springs to center the control handles in the neutral position if desired.

Figures 3, 4, 5, 6:
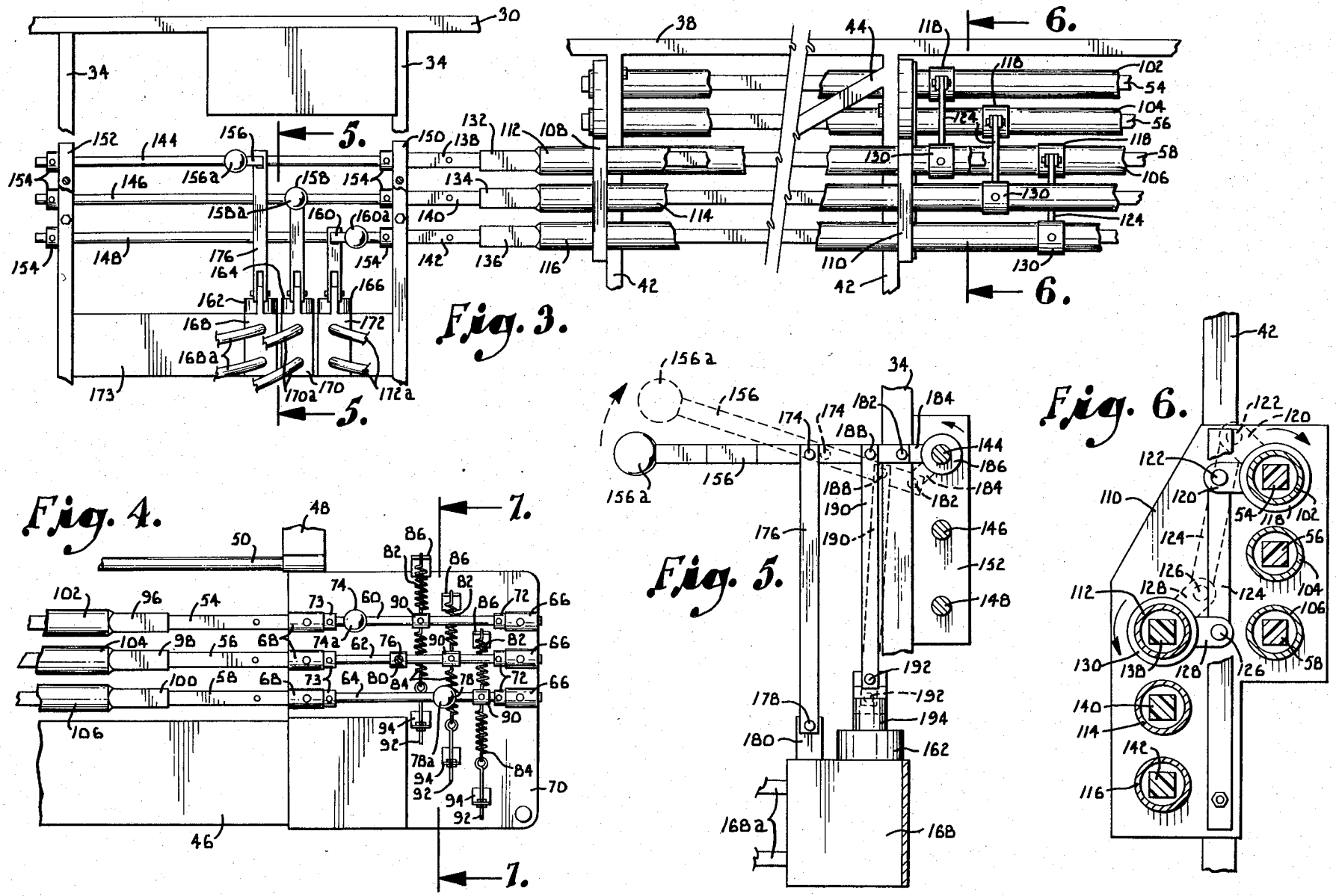
FIG. 3 is a fragmentary side elevational view on an enlarged scale showing the lower portion of the control linkage for the ladder, with the break lines indicating continuous length and portions broken away for purposes of illustration.
FIG. 4 is a fragmentary side elevational view on an enlarged scale showing the upper portion of the control linkage.
FIG. 5 is a fragmentary sectional view on an enlarged scale taken generally along line 5—5 of FIG. 3 in the direction of the arrows.
FIG. 6 is a fragmentary sectional view on an enlarged scale taken generally along line 6—6 of FIG. 3 in the direction of the arrows.

As best shown in FIG. 4, the square rods 54, 56 and 58 are received in square sleeves 96, 98 and 100 which are secured to the upper ends of respective tubes 102, 104 and 106. The tubes are hollow cylindrical members and may be constructed of stainless steel or any other suitable material. The tubes 102, 104 and 106 are mounted for rotation on the middle ladder section 26. As best shown in FIG. 3, the lower end of each tube is supported for rotation on a bracket 108 secured to one of the vertical bars 42 located near the lower end of the middle ladder section. Intermediate portions of the tubes extend through and are supported for rotation by a similar bracket 110 secured to another vertical bar 42 of the middle ladder section. The brackets 108 and 110 support tubes 102, 104 and 106 for rotation while preventing the tubes from sliding axially on the middle ladder section.

It is important to note that the tubes 102, 104 and 106 are mounted inwardly of the bars which form the side of the middle ladder section 26, as best shown in FIG. 6. The rods 54, 56 and 58 are mounted outwardly of the corresponding side of the upper ladder section 26. Since the upper ladder section 28 is narrower than the middle section 26, this arrangement permits the tubes and rods to be properly aligned with one another.

The rods 54, 56 and 58 have the same size and shape as the square sleeves 96, 98 and 100 so that rotation of each rod causes the corresponding tube to rotate at the same time and in the same direction. The rods are received in the tubes in a telescoping manner so that they can extend out of and retract into the tubes during extension and retraction of the upper ladder section 26 relative to the middle ladder section 28.

The brackets 108 and 110 rotatably support three additional tubes 112, 114 and 116 which are located below and outwardly of the corresponding tubes 102, 104 and 106 in the other set of tubes. Tubes 112, 114 and 116 are supported for rotation and are held against axial movement relative to the middle ladder section 26. As best shown in FIG. 6, tubes 112, 114 and 116 are located outwardly of and below the other tubes 54, 56 and 58 and are located outwardly of the bars which form the side of the middle ladder section 26. All of the tubes extend substantially the entire length of the middle ladder section.

Three crank mechanisms connect the two upper tubes 102 and 112, the two intermediate tubes 104 and 114, and the two lower tubes 106 and 116. Each crank mechanism is constructed and operates in the same manner. As best shown in FIG. 6, each tube in the inner set of tubes is provided with a collar 118 which is secured around the tube by a set screw or similar fastening device. Each collar 118 has a pair of outwardly projecting lugs 120. A pivot pin 122 pins the top end of an arm 124 between lugs 120. The bottom end of each arm 124 is pinned at 126 between a pair of lugs 128 which project inwardly from a collar 130 secured to the corresponding tube in the other set of tubes. In the normal position of the parts, the lugs 120 and 128 are parallel and project from their tubes in opposite directions. When one of the tubes 102, 104 or 106 is rotated, the crank linkage rotates the corresponding tube 112, 114 or 116 through the same arc but in an opposite direction, as best illustrated by the directional arrows and the broken lines shown in FIG. 6.

Referring particularly to FIG. 3, tubes 112, 114 and 116 are provided at their lower ends with respective sleeves 132, 134 and 136 each having a square cross section. Extending through the sleeves 132, 134 and 136 and into the associated tubes are square rods 138, 140 and 142, respectively. Connected with the lower ends of rods 138, 140 and 142 are cylindrical rods 144, 146 and 148, respectively. The cylindrical rods form continuations of the square rods and are supported for rotation by brackets 150 and 152 secured to vertical bars 34 on one side of the lower ladder section 24. rods 138, 140 and 142 are thus mounted for rotation on the lower ladder section and are held against axial movement thereon by collars 154 fitted on the cylindrical rods 144, 146 and 148. Rods 138, 140 and 142 are mounted inwardly of the bars forming the side of the lower ladder section in order to properly align with the corresponding tubes 112, 114 and 116.

The lower rods 138, 140 and 142 are received in a telescoping manner in the tubes 112, 114 and 116 so that the rods can extend out of and retract into the tubes during extension and retraction of the middle ladder section 26 relative to the lower ladder section 24. Rods 138, 140 and 142 fit closely in the square sleeve 132, 134 and 136 so that the rods and tubes rotate together in unison.

The rods 138, 140 and 142 are provided with respective control levers 156, 158 and 160 which control valve spools 162, 164 and 166. The valve spools are included in hydraulic valves 168, 170 and 172 which control the flow of hydraulic fluid to and from the hydraulic cylinders and motor of the aerial ladder. The valves are mounted to a plate 173 extending between bars 34 at the base of the ladder.

Valve 168 is equipped with a pair of hydrauic fluid lines **168*a* which lead to the hydraulic cylinder 20 that serves to raise and lower ladder 10 in the elevation mode of operation. When valve spool 162 is depressed from the neutral position shown in FIG. 3, the rod of cylinder 20 is extended to raise ladder 10. Conversely, when spool 162 is raised, the rod of cylinder 20 is retracted to lower the aerial ladder. Spool 164 controls the rotation drive motor M and causes the motor to rotate ladder 10 in one direction when depressed from the neutral position and in the opposite direction when raised from the neutral position. Hydraulic lines 170*a* extend from valve 170 to the motor M. The remaining valve spool 166 causes the rod of hydraulic cylinder 52 to extend when the valve spool is depressed and to retract when the spool is raised, thereby controlling the extension and retraction of the multiple section aerial ladder 10. Valve 172 has hydraulic lines 172*a* which lead to cylinder 52**.

The operating mechanism for each valve 168, 170 and 172 is the same, and the mechanism for valve 168 is illustrated in FIG. 5. Near its midpoint, the valve control lever 156 is pivoted at 174 to the top end of a link 176. The bottom end of link 176 is pivoted at 178 to a lug 180 extending from the body of valve 168. The valve actuating end of lever 156 is opposite the handle end and is pivoted at 182 to a lug 184 which extends from a collar 186 fixed to the corresponding cylindrical rod 144. At a location between pin 174 and 182, lever 156 is pinned at 188 to the top end of a bar 190. The bottom end of bar 190 is pinned at 192 to a lug 194 extending from the valve spool 162.

Each of the lower control levers 156, 158 and 160 is a beam type lever which can be moved up and down about the pivot pin 174. Due to the location of the handle end of the lever on one side of the pivot pin and the valve actuating end of the lever on the opposite side of the pivot pin, each lever depresses its valve spool when raised and extends its valve spool when lowered. Due to the connections between rods 144, 146 and 148 and the control lever 156, 158 and 160, rotation of the control rods in opposite directions causes the corresponding control levers to pivot up and down and thus depresses and extends the valve spools.

The control levers 156, 158 and 160 are provided with round knobs **156*a*, 158*a* and 160*a* on their handle ends. The control levers are staggered as shown in FIG. 3** and are accessible to a worker stationed at the base of the aerial ladder.

In operation of the aerial ladder, the control linkage of the present invention permits its elevation, rotational position, and length to be controlled from either the ground or from the top end of the ladder. A worker stationed on the ground can change the elevation of the ladder by moving the elevation control lever 156 up or down from its neutral horizontal position. If the handle end of lever 156 is raised to the broken line position shown in FIG. 5, valve spool 162 is depressed into the valve body 168, thereby causing the rod of cylinder 20 to extend to raise the aerial ladder 10. When lever 156 is released, it returns to the neutral position shown in solid lines in FIG. 5, and cylinder 20 is then maintained in the position it has assumed at the time the lever is released. Downward movement of lever 156 from the neutral position raises spool 162 and causes cylinder 20 to retract for lowering of the ladder.

In a similar manner, levers 158 and 160 can be raised or lowered in order to depress or extend the associated valve spools 164 and 166 in the rotation and extension modes of operation. When the handle end of lever 158 is raised, motor M is driven in a direction to rotate turret 14 to the left, and the turret is rotated in an opposite direction when lever 158 is lowered. Raising and lowering of lever 160 causes cylinder 52 to extend and retract in order to extend and retract the upper and middle sections of the aerial ladder.

The ladder can be similarly controlled by a worker positioned on the upper ladder section 28 or in a working basket (not shown) carried on the upper ladder section. Raising of handle 74 causes rod 60 to rotate in a clockwise direction as viewed in FIG. 7. The square rod 74 is also rotated, as is tube 102 due to the fit between the square rod 54 and the square sleeve 96. Tube 102 is thus rotated in a clockwise direction as viewed in FIG. 6, and tube 112 is rotated in a counterclockwise direction due to the crank linkage provided by arm 124 and lugs 120 and 128. Rotation of tube 112 is accompanied by concurrent rotation of rod 138 due to the fit of the square rod in the square sleeve 132. Rod 144 is thus rotated in a counterclockwise direction as indicated by the directional arrow in FIG. 5, and lever 156 is raised to the broken line position. This causes spool 162 to be depressed into the body of valve 168, thereby extending the rod of cylinder 20 and raising the aerial ladder 10. When handle 74 is releasd, spring 82 returns it to the neutral position to stop the extension of cylinder 20.

When handle 74 is moved downwardly from the neutral position, the control linkage causes valve spool 162 to extend out of the body of valve 168 and also moves the handle end of lever 156 downwardly. This results in retraction of cylinder 20 and lowers the aerial ladder 10. The remaining control handles 76 and 78 can likewise be moved up and down from the neutral position to cause ladder 10 to rotate in opposite directions in the rotational mode and to extend or retract the ladder in the extension mode, depending upon whether the handles 76 and 78 are moved upwardly or downwardly.

In all cases, the crank linkage between corresponding pairs of tubes causes the connected tubes to rotate in opposite directions. As a result, the handle end of each of the lower levers 156, 158 and 160 is raised when the corresponding upper control handle 74, 76 or 78 is raised. Conversely, the lower levers are moved downwardly when the corresponding upper levers are moved downwardly. Thus, a worker accustomed to raising a control lever in order to raise or extend the aerial ladder or rotate it to the right can follow his usual practice with the upper control handles.

It should be noted that in cases where the lower control levers are direct acting rather than beam type levers, the tubes can be connected in a manner to cause corresponding tubes to rotate in the same direction. However, since beam type levers provide better control of the ladder movement, they are preferred and crank linkages of the type shown in FIG. 6 are used. It should also be noted that the control linkage can be used with a two section ladder as well as with the three section ladder shown in the drawings. In addition, only one or two of the ladder functions can be controllable from the top end of the ladder rather than all three functions. It should further be noted that other equipment and/or functions associated with the aerial ladder can be controlled in a similar manner from the top end of the ladder, either instead of or in addition to the functions described herein with reference to a particular embodiment of the invention.

The two sets of rods and tubes included in the control linkage are mounted at an unobtrusive location extending along the sides of the ladder sections. The rods are able to extend out of and retract into the tubes in order to accommodate extension and retraction of the ladder without occupying any of the working areas of the ladder.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. In a multiple section aerial ladder having a lower ladder section supported for rotation about a generally vertical rotational axis and for up and down pivotal movement about a generally horizontal pivot axis, a middle ladder section supported for extension and retraction on the lower section, and an upper ladder section supported for extension and retraction on the middle section, a control arrangement comprising:

an upper set of parallel rods mounted for rotation on the upper ladder section;

an upper set of hand levers coupled with the respective rods in a manner to rotate each rod in opposite directions from a neutral position when the corresponding lever is displaced in opposite directions from a neutral position;

a first set of parallel tubes mounted for rotation on the middle ladder section and receiving the respective rods in a manner to effect rotation of each tube when the corresponding rod is rotated, said rods being extensible out of and retractable into the tubes to accommodate extension and retraction of the upper ladder section;

a second set of parallel tubes mounted for rotation on the middle ladder section, each tube in said second set having a corresponding tube in said first set, the tubes in said first and second sets being substantially parallel and located generally side by side;

means for coupling the corresponding tubes together in pairs in a manner to rotate each tube in said second set when the corresponding tube in the first set is rotated;

a lower set of parallel rods mounted for rotation on the lower ladder section and received in the respective tubes in said second set in a manner to rotate each rod in the lower set when the corresponding tube in said second set is rotated, said rods in the lower set being extensible out of and retractable into the tubes in said second set to accommodate extension and retraction of the middle ladder section;

a lower set of hand levers including an elevation control lever, a rotation control lever and an extension control lever to which the respective rods in said lower set are coupled in a manner to displace each lever in said lower set in opposite directions from a neutral position when the corresponding rod is rotated in opposite directions from a neutral position thereof, said levers in the lower set being accessible for manual displacement from the neutral position;

means for pivoting the lower ladder section up and down about said pivot axis when the elevation control lever is displaced in opposite directions from the neutral position;

means for rotating the lower ladder section in opposite directions about said rotational axis when the rotation control lever is displaced in opposite directions from the neutral position; and means for extending and retracting the middle and upper ladder sections when the extension control lever is displaced in opposite directions from the neutral position, whereby the elevation, rotation and extension of the ladder can be controlled by the upper or lower set of hand levers.

2. The invention of claim 1, including yieldable means for urging the hand levers in said upper set toward the neutral position.

3. The invention of claim 1, wherein:

said hand levers in the upper set are directly coupled with the rods in the upper set to rotate each rod in the direction the corresponding lever is moved;

each hand lever in the lower set is movable about a pivot point and has a handle and a valve actuating end located on opposite sides of the pivot point; and said coupling means is operable to rotate the corresponding tubes in each pair in opposite directions to each other.

4. The invention of claim 3, wherein said coupling means for each pair of corresponding tubes includes a crank arm connected with both tubes in a manner to rotate the tubes in opposite directions to each other.

5. In a multiple section aerial ladder having a plurality of ladder sections supported for extension and retraction to vary the length of the ladder and a base providing a generally vertical rotational axis for the ladder and a generally horizontal pivot axis about which the ladder can pivot up and down, the improvement comprising:

a plurality of parallel rods mounted for rotation on one of the ladder sections;

elevation control, rotation control and extension control handles coupled with the respective rods in a manner to rotate each rod in opposite directions from a neutral position when the corresponding handle is moved upwardly and downwardly from a neutral position;

a first set of tubes comprising a plurality of parallel tubes mounted for rotation on another ladder section adjacent said one section, said tubes receiving the respective rods in a manner to effect rotation of each tube when the corresponding rod is rotated and permitting the rods to extend out of and retract into the tubes to accommodate extension and retraction of said other ladder section relative to said one section;

a second set of tubes comprising a plurality of tubes mounted for rotation on said other ladder section at positions spaced from and parallel to the tubes in said first set of tubes, each tube in said second set having a corresponding tube in said first set;

linkage means for connecting each pair of corresponding tubes in the first and second sets of tubes in a manner to rotate each tube in the second set in one rotative direction when the corresponding tube in the first set is rotated in the opposite direction;

valve means for controlling the elevation, rotation and extension of the ladder;

elevation control, rotation control and extension control hand levers mounted adjacent the base of the ladder, each lever being movable about a pivot point and having a handle end and an actuating end located on opposite sides of the pivot point;

means for connecting said hand levers with said valve means in a manner to effect movement of the ladder about said pivot axis in one pivotal direction when the handle end of said elevation control lever is moved upwardly and in the opposite pivotal direction when the handle end of said elevation control lever is moved downwardly, to effect movement of the ladder about said rotational axis in one rotational direction when the handle end of said rotation control lever is moved upwardly and in the opposite rotational direction when the handle end of said rotation control lever is moved downwardly, and to effect extension and retraction of the ladder when the handle end of said extension control lever is moved upwardly and downwardly; and means for connecting the tubes in said second set of tubes with said valve means in a manner to effect movement of the ladder in said one pivotal direction when said elevation control handle is moved upwardly and in said opposite pivotal direction when said elevation control handle is moved downwardly, to effect movement of the ladder in said one rotational direction when said rotational control handle is moved upwardly and in said opposite rotational direction when said elevational control handle is moved downwardly, and to effect extension and retraction of the ladder when said extension control handle is moved upwardly and downwardly.

6. The improvement of claim 5, including yieldable means for urging each control handle toward the neutral position thereof.

7. The improvement of claim 5, wherein said linkage means includes a crank arm for each pair of corresponding tubes connected with both tubes in a manner to translate rotation of the tube in the first set into opposite rotation of the corresponding tube in the second set.

8. The improvement of claim 5, wherein said linkage means includes for each pair of corresponding tubes:

a pair of collars fixed to the respective tubes; and a crank arm having opposite ends pivotally coupled with the respective collars in a manner to translate rotation of the tube in the first set into opposite rotation of the corresponding tube in the second set.

9. The improvement of claim 5, wherein:

each rod has a non-circular cross section presenting a selected shape; and each tube in said first set of tubes has a portion thereof which receives the corresponding rod and which has said selected shape to permit each rod to extend and to retract and to rotate the corresponding tube when the rod is rotated.

10. In a multiple section aerial ladder having upper, middle and lower ladder sections and supported for movement in an elevation mode in which the ladder is moved up and down about a generally horizontal pivot axis, a rotation mode in which the ladder is turned about a generally vertical rotational axis, and an extension mode in which the upper and middle lower sections are extended and retracted to vary the length of the ladder, the improvement comprising:

a first pair of elongate telescoping members for at least one of said modes, said first pair of members being respectively mounted for rotation on the upper and middle ladder sections and fitting together in a manner to rotate together and to extend and retract relative to one another in telescoping fashion;

a second pair of elongate telescoping members for said one mode, said second pair of members being respectively mounted for rotation on the middle and lower ladder sections and fitting together in a manner to rotate together and to extend and retract relative to one another in telescoping fashion, said members on the middle ladder section being substantially parallel to one another and located generally side by side;

a linkage for said one mode coupling the telescoping members on the middle ladder section together in a manner to rotate the telescoping member in the second pair on the middle ladder section when the telescoping member in the first pair on the middle ladder section is rotated;

an upper hand lever for said one mode accessible from the upper ladder section, said one upper lever being coupled with the telescoping member on the upper ladder section in a manner to rotate such member in opposite directions from a neutral position when the lever is moved in opposite directions from a neutral position, whereby the telescoping member on the lower ladder section is rotated in opposite directions from a neutral position thereof in response to movement of the upper hand lever in opposite directions from its neutral position;

a lower hand lever for said one mode located adjacent the lower end of the lower ladder section and accessible for manual movement in opposite directions from a neutral position;

valve means for operating the ladder in said one mode when the lower hand lever is moved in opposite directions from its neutral position; and means for coupling the telescoping member on the lower ladder section with the lower hand lever in a manner to effect movement of said lower lever in opposite directions from its neutral position in response to rotation of the telescoping member on the lower ladder section in opposite directions from its neutral position, whereby the said one mode of the ladder can be controlled by the upper hand lever and by the lower hand lever.

11. The improvement of claim 10, wherein:

each ladder section has opposite sides and the ladder sections nest within one another when the ladder is retracted;

said first pair of telescoping members includes an elongate rod mounted for rotation on the upper ladder section outwardly of one side thereof and an elongate tube mounted for rotation on the middle ladder section inwardly of one side thereof in alignment with the rod; and said second pair of telescoping members includes an elongate tube mounted for rotation on the middle ladder section outwardly of said one side thereof and an elongate rod mounted for rotation on the lower ladder section inwardly of one side thereof in alignment with the corresponding tube.

* * * * *